United States Patent [19]

Case et al.

[11] Patent Number: 5,009,563

[45] Date of Patent: Apr. 23, 1991

[54] MOBILE VEHICLE AND METHOD FOR HANDLING PAPER ROLLS

[75] Inventors: Marvin L. Case, Aberdeen; Robert E. Sturm, Hoquiam; David P. Herigstad, Aberdeen, all of Wash.

[73] Assignee: Haines & Emerson, Inc., Hoguiam, Wash.

[21] Appl. No.: 366,880

[22] Filed: Jun. 14, 1989

[51] Int. Cl.[5] ..... B60P 3/00

[52] U.S. Cl. ..... 414/470; 410/49; 414/346; 414/350; 414/495; 414/590; 414/684; 414/911; 298/17.6

[58] Field of Search ..... 414/24.5, 346, 350, 414/470, 471, 495, 589, 590, 620, 621, 684, 745.9, 908, 910, 911, 10; 298/17.6, 18; 410/36, 47, 49, 68

[56] References Cited

U.S. PATENT DOCUMENTS

| | | | |
|---|---|---|---|
| 1,417,096 | 5/1922 | Mueller . | |
| 1,740,260 | 12/1929 | Naugle et al. | 414/684 |
| 1,910,398 | 5/1933 | Ludington | 414/350 X |
| 2,198,644 | 4/1940 | Wettengel | 414/684 X |
| 2,674,386 | 4/1954 | Larson . | |
| 3,087,630 | 4/1963 | Karnow et al. | 414/590 |
| 3,430,981 | 3/1969 | Tarantola | 410/49 X |
| 3,658,011 | 4/1972 | West et al. | 410/49 X |
| 3,741,407 | 6/1973 | Spannlang | 414/590 X |
| 3,768,669 | 10/1973 | Moore | 414/346 X |
| 3,820,665 | 6/1974 | Fisher | 414/590 |
| 4,051,966 | 10/1977 | Cotton | 414/620 X |
| 4,067,451 | 1/1978 | Winters . | |
| 4,131,206 | 12/1978 | Kawada et al. . | |
| 4,242,031 | 12/1980 | McMullen | 414/470 |
| 4,261,676 | 4/1981 | Balling Se | 414/24.5 |
| 4,461,455 | 7/1984 | Mills et al. | 414/589 X |
| 4,755,099 | 7/1988 | Belveal | 414/911 X |
| 4,863,335 | 9/1989 | Harigstad et al. | 414/495 |
| 4,915,577 | 4/1990 | Fraser | 414/495 X |
| 4,948,060 | 8/1990 | Kurz et al. | 414/495 X |

FOREIGN PATENT DOCUMENTS

| | | | |
|---|---|---|---|
| 2418820 | 1/1975 | Fed. Rep. of Germany | 414/910 |
| 597597 | 3/1978 | U.S.S.R. | 414/350 |
| 740559 | 6/1980 | U.S.S.R. | 414/495 |
| 1230953 | 5/1986 | U.S.S.R. | 414/471 |

OTHER PUBLICATIONS

FMC roll-handling system developed in approximately 1984.

*Primary Examiner*—Robert J. Spar
*Assistant Examiner*—Robert S. Katz
*Attorney, Agent, or Firm*—Seed and Berry

[57] ABSTRACT

A mobile vehicle is provided with a cradle that can be tilted or rotated. The cradle can also be raised and lowered. The cradle has leaves which are upwardly and outwardly sloping to handle a large cylindrical paper roll by allowing the roll to roll down and center itself in the cradle.

6 Claims, 3 Drawing Sheets

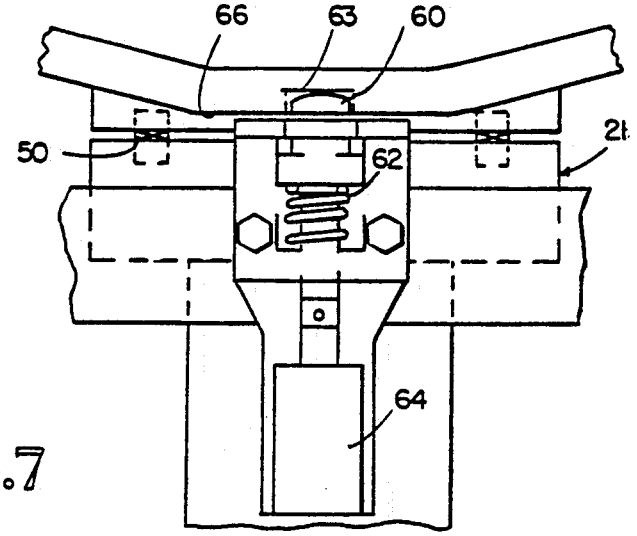
FIG.7
FIG.8
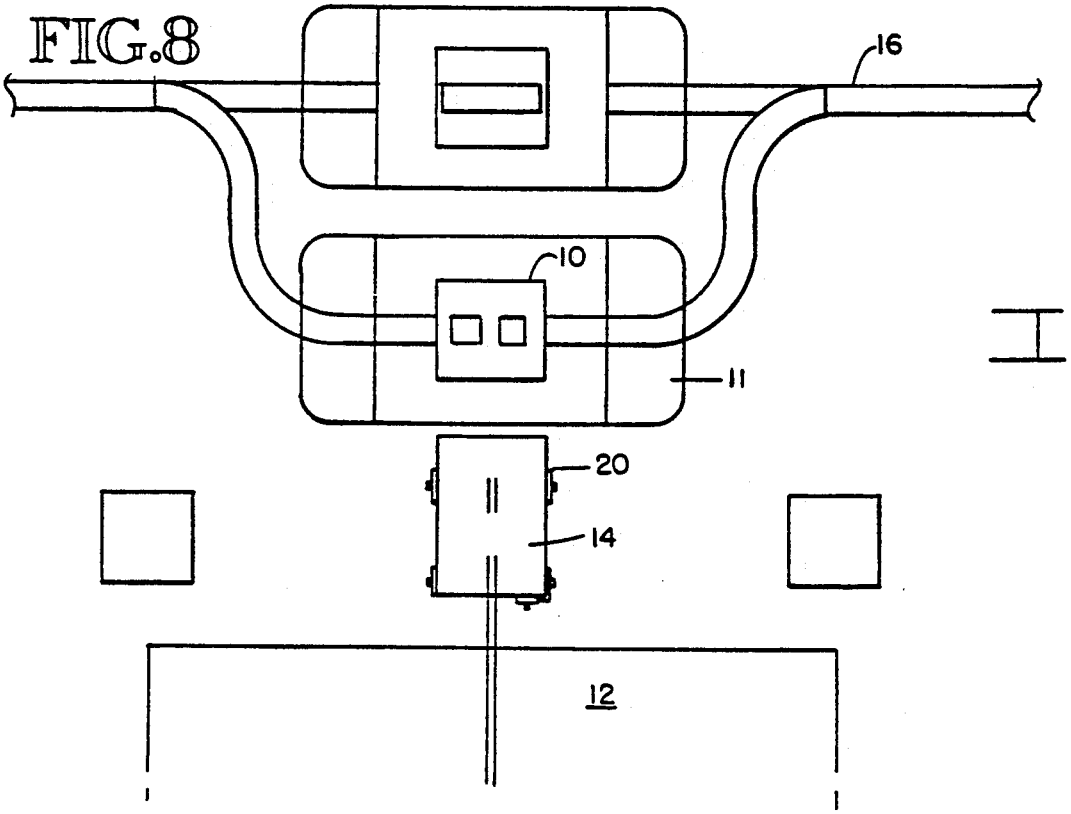

MOBILE VEHICLE AND METHOD FOR HANDLING PAPER ROLLS

DESCRIPTION

1. Field of the Invention

This invention pertains to paper roll handling apparatus of the type used in printing pressrooms or warehouses for storing and handling large cylindrical paper rolls. The invention has application also for handling other noncylindrical objects such as newspaper bundles.

2. Description of the Prior Art

Printing presses for use in making newsprint or other printed materials utilize large numbers of paper rolls during the printing operation. These paper rolls are held in spokes of reels adjacent the printing press. Generally, a paper roll at one of the positions in the reel is being used by the printing press. Two or more additional rolls are mounted on the reel in reserve positions to be moved into use position when the existing paper roll in the printing press is consumed. The handling of these large paper rolls, which can weigh 4,000 pounds and be up to 50 inches in diameter and 55 inches in length, is difficult since the rolls will tend to roll if carried on their cylindrical surface and are equally unstable if carried in their vertically upright position.

A new technology has been developed which carries these paper rolls on automatically guided vehicles. These vehicles will pick a roll up at a warehousing location and deliver it either directly into the reel at the printing press or to a transfer cart adjacent the printing press. The transfer cart carries the roll further into the position adjacent the reel of the printing press. In both of these roll handling situations, it is desirable to be able to load and offload the rolls either from the automatically guided vehicle or the transfer cart in an efficient and automated manner to reduce the cost of storing and handling the paper rolls.

For purposes of brevity, the term vehicle in this application shall mean a cart, an automatically guided vehicle, or any other type of roll handling vehicle.

It is an object of this invention to provide a vehicle that can receive or discharge a large paper roll by tilting the roll support surface on the vehicle.

It is another object of this invention to provide a mobile vehicle that can both roll a cylindrical paper roll on and off vehicle and can also rotate a horizontally positioned roll about a vertical axis.

Basically, these objects are obtained by providing a mobile vehicle with a roll support cradle. The cradle has upwardly and outwardly flared opposite leaves for guiding a horizontally positioned cylindrical roll into a central position using gravity. The cradle is then moved in various directions so that the leaves can be raised or lowered. In one preferred embodiment, the opposite leaves can be raised or lowered relative to one another so that one leaf can be raised or lowered relative to the other, allowing a roll to be rolled off the cradle or a roll rolled onto the cradle. In one embodiment, the leaves can also be moved simultaneously in the same direction to simply raise or lower the cradle.

In one embodiment, the cradle also is mounted on rotary bearings so that the cradle can be rotated about a vertical axis to reposition the free end of the web of paper of the roll for discharge either clockwise or counterclockwise. The cradle can be locked in a desired rotary position by a releasable detent. Preferably, the cradle will become automatically locked into position when the desired rotational position is reached.

By providing a cradle of the type described in which the leaves can be raised or lowered independently, a roll can be easily transferred from one vehicle to another. To discharge a roll, one leaf is raised relative to the other until gravity rolls the roll off the cradle. To catch a roll that is being delivered to the vehicle, one leaf is moved relative to the other but with both leaves being raised so that the roll will roll down one leaf, partly up the other, and back and forth until it centers itself in the cradle. By using the rolling technique for moving rolls from one vehicle to another, the delivery, onloading, or offloading of these vehicles can be made automated without the intervention of forklift carriers or other devices for providing the transfer from one vehicle to another.

BRIEF DESCRIPTION OF THE DRAWINGS

FIG. 7 is a schematic detail of a detent mechanism for locking the cradle against rotational movement.

FIG. 8 is a schematic layout of a typical printing press facility.

DESCRIPTION OF THE EMBODIMENTS

Figure 1:
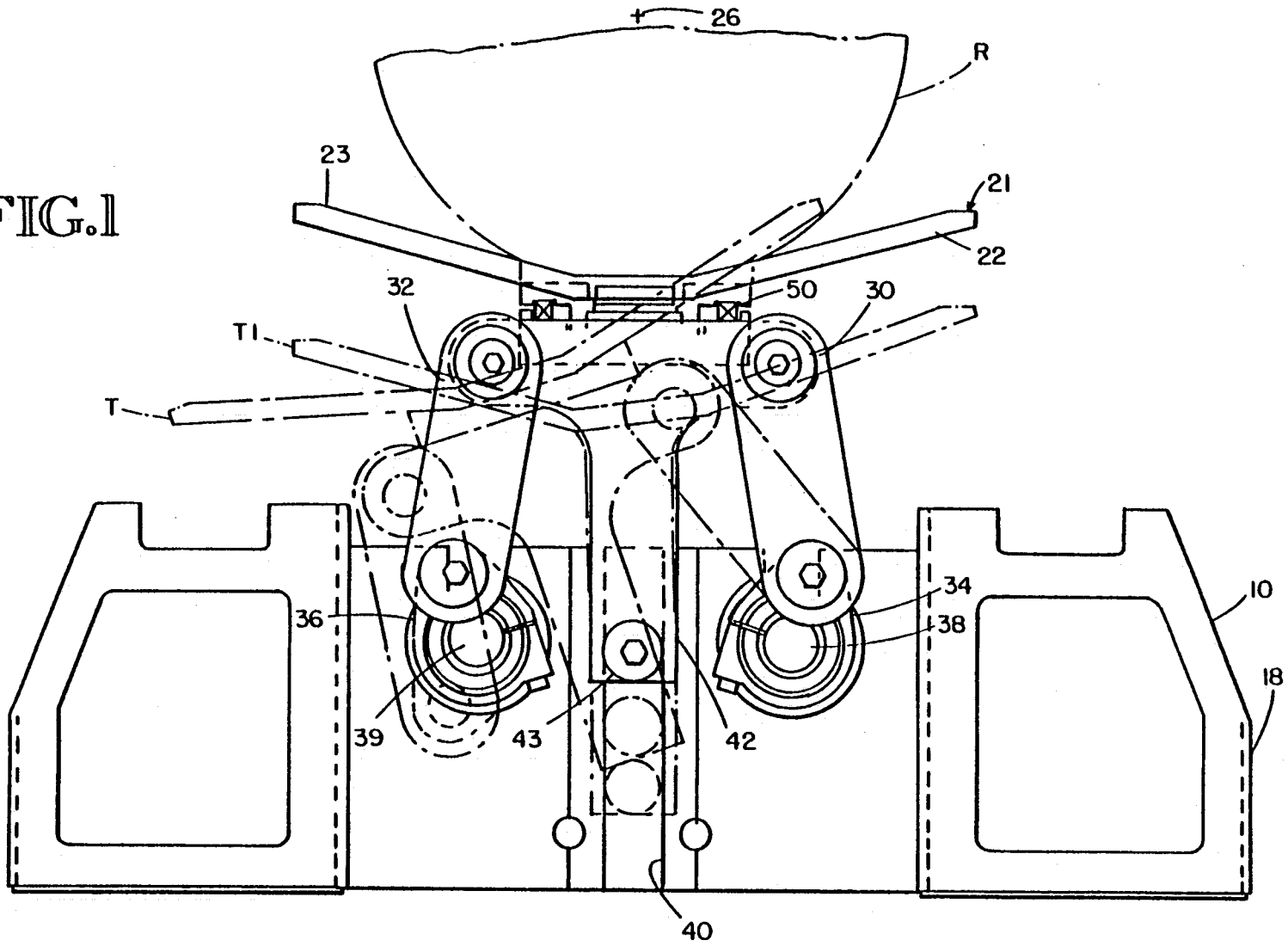
FIG. 1 is a fragmentary side elevation of a vehicle embodying the principles of the invention.

As best shown in FIG. 8, a typical printing pressroom layout shows a mobile vehicle such as a cart 14 movable from a discharge station 11 to a printing press location 12. An automatically guided vehicle 10 runs on an embedded track 16 which track continues on through a paper roll storage warehouse or the like. It should be understood that the principles of the invention described and claimed herein apply equally whether the mobile vehicle is the cart 14 or the automatically guided vehicle 10.

For the purposes of this description, the details of the vehicle 10 will be described. As best shown in FIG. 1, the vehicle 10 includes a frame 18 mounted on wheels 20 (FIG. 8). A cradle 21 is formed from a right leaf 22 and a left leaf 23 forming a somewhat shallow "U" shape. A roll R having a central axis 26 is illustrated in FIG. 1 in phantom lines centered on the cradle. In the position shown the roll will center itself by gravity into the center of the cradle.

Figure 2:
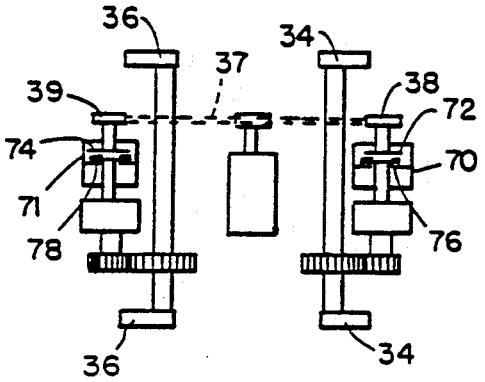
FIGS. 2 and 2A through FIGS. 6 and 6A are operational schematics showing the cradle in various positions.
Figure 2A:
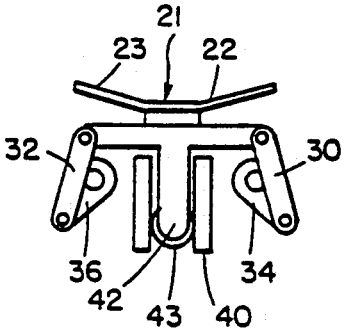

The cradle can be tilted or elevated, as shown in FIG. 1. For this purpose, the cradle is provided at either end with sets of right-hand links 30 and a left-hand links 32 (FIGS. 1, 2, and 2A). The links are pivotally connected at first ends to the cradle. The opposite ends of the links are connected respectively to eccentrics or eccentric links 34 and 36. The eccentrics are rotated by a motor and belt drive 37. The motor and belt drive simultaneously rotate two input shafts in opposite directions. Conventional clutch-brake transmissions convert the rotational input from the shafts 38 and 39 into various motions of the eccentrics to position the leaves of the cradle.

Various operating conditions for manipulating the leaves are shown in FIGS. 2 and 2A through FIGS. 6 and 6A. In FIGS. 2 and 2A, the input shafts are disengaged by the clutches 72 and 74 while the leaves are held stationary by brakes 76 and 78.

Figure 3:
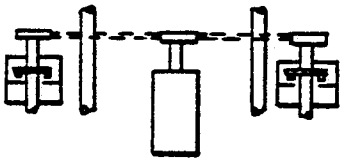
Figure 3A:
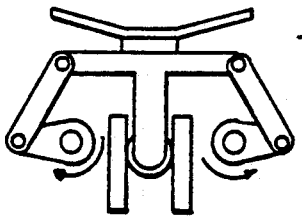

In FIGS. 3 and 3A, the brakes are released and the leaves are raised simultaneously at the same speed.

Figure 4:
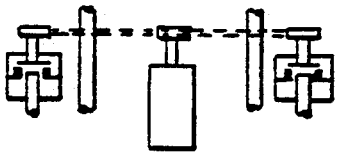
Figure 4A:
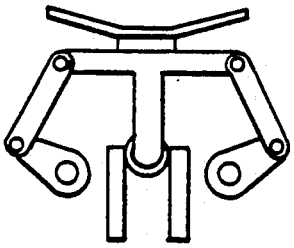

In FIGS. 4 and 4A, the leaves have been elevated to their highest position, and the brakes re-engaged.

Figure 5:
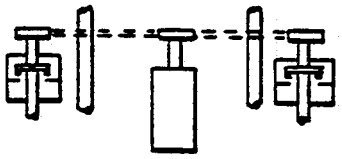
Figure 5A:
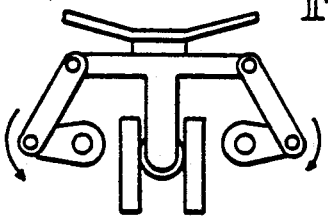

In FIGS. 5 and 5A, the leaves are being driven downwardly simultaneously at the same speed.

Figure 6:
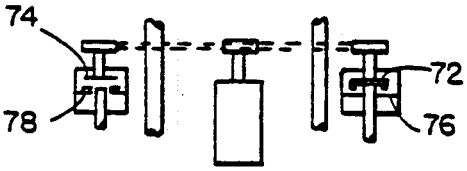
Figure 6A:
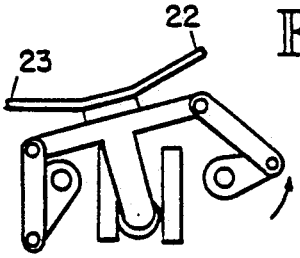

In FIGS. 6 and 6A, the brake 78 is set while the brake 76 has been released. Clutch 72 is engaged while clutch 74 is released. In this condition, the left-hand eccentric 36 remains stationary and the right-hand eccentric is rotated, for example, counterclockwise. This causes tilting of the cradle by raising the right-hand leaf. Obviously, either leaf can be raised or lowered independently of the other.

Mounted in a track 40 in the center of the frame 18 is a slide 42 having a roller 43. The slide is coupled to the cradle. The lower end of the slide and roller 43 can move only in the vertical direction and becomes the pivot point for tilting the cradle.

By rotating one link relative to the other, one end of the cradle will be lowered or raised relative to the other end with the cradle pivoting about the roller 43. Thus, as shown in one phantom line position T in FIG. 1, the right-hand eccentric 34 is rotated counterclockwise, causing the right-hand link 30 to raise and the right-hand leaf 22 to be tilted. This will cause a roll to roll by gravity off to the left of the cradle.

In an intermediate position, as for example shown by the T1 in FIG. 1, the cradle can be set to receive a roll. The roll will be rolled off another vehicle onto a slightly elevated left-hand leaf. It will then roll clockwise to the right rolling down past the center of the cradle and partially up the right-hand leaf. The roll will then roll back and forth partway up the leaves until it centers itself in the cradle.

For transporting the rolls, the cradle is moved into a lowered position with the roll centered and lowered.

The eccentrics 34 and 36 can be moved in either direction relative to one another so that offloading and onloading of the rolls relative to the cradle can occur from either the left-hand or right-hand direction. By moving both links simultaneously, the cradle can be moved vertically up or down.

Preferably the cradle also is provided with a set of bearings 50 to enable the upper half of the cradle to rotate relative to the lower half. The rotation can be done manually or by a powered rotational device.

As best shown in FIG. 7, a detent 60 is spring biased by a spring 62 into the upper position. The detent is received in an aperture 63 in the upper half of the cradle. A solenoid 64 can electrically retract the detent from the opening 63. The bottom surface of the cradle at 66 is sloped so that once the detent is released by the solenoid and the upper half of the cradle has begun to rotate, the solenoid can be deenergized. The detent will then move up and rest against the sloped surface of the cradle. As the cradle makes 180 degrees of rotation, a second aperture on the other side of the cradle will then automatically become aligned over the detent. The spring will then automatically set the detent back into the aperture to lock the cradle against further rotation.

As illustrated and described, the vehicle shows the tilting and rotational capabilities. While the preferred embodiments have been described in the drawings, it should be understood that variations will be apparent to those in the art. Accordingly, the invention is not to be limited to the specific embodiments illustrated in the drawings.

We claim:

1. A mobile vehicle for handling large cylindrical paper rolls, comprising:

a roll support cradle on a main frame, said cradle having a central recess formed by upwardly and outwardly diverging opposite elongated leaves for supporting and guiding a cylindrical roll to roll along the leaves and center itself in the central recess of the cradle when lying on the cradle with the roll's central longitudinal axis horizontal;

said main frame having a central cradle support track for pivotally supporting said cradle and limiting the cradle's movement with respect to the track to vertical and pivotal movement;

means for manipulating the cradle so that the leaves can be raised or lowered; and wherein each of said leaves can be raised or lowered in different directions relative to each other and on opposite sides of said central support track for tilting the cradle and thereby rolling a paper roll onto or cut of the cradle central recess from either lateral direction relative to said central support track, and the leaves of the cradle can be moved laterally with respect to the central support track by the pivoting of the cradle about a horizontal axis.

2. The vehicle of claim 1 wherein said leaves can be raised or lowered simultaneously in the same direction for elevating or lowering the cradle.

3. The vehicle of claim 1, including means for rotating said cradle about a vertical axis.

4. The vehicle of claim 3, including detent means for releasably locking the cradle against rotation about the vertical axis.

5. A mobile vehicle for handling large cylindrical paper rolls, comprising:

a roll support cradle on a main frame, said cradle having upwardly and outwardly flared opposite leaves for guiding a cylindrical roll to center itself in the cradle when lying on the cradle with the roll's central longitudinal axis horizontal;

means for manipulating the cradle so that the leaves can be raised or lowered;

said cradle having a central positioning slide having a lower end;

said means for manipulating the cradle, including:

a track on said frame for confining the lower end of the slide of said cradle to vertical translation but allowing the cradle to pivot about a horizontal axis;

links each having a first end, said links each having a second end pivotally coupled to said cradle; and means coupled to the first end of the links for raising and lowering the links so that equal movement of the links in the same direction will cause the slide to move vertically in the track and the cradle move vertically, whereas relative directional movement between the links will cause the cradle to tilt about the slide with or without additional vertical movement of the slide.

6. A mobile vehicle for handling large cylindrical paper rolls, comprising:

a roll support cradle on a main frame, said cradle having upwardly and outwardly flared opposite leaves for guiding a cylindrical roll to center itself in the cradle when lying on the cradle with the roll's central longitudinal axis horizontal;

means for manipulating the cradle so that the leaves can be raised or lowered;

wherein the leaves can be raised or lowered in different directions to tilt the cradle, or raised or lowered in the same direction for elevating or lowering the cradle; and said means for manipulating the cradle including a motor and belt drive, clutch input shafts driven in opposite directions by said motor and belt drive, a central slide fixed to said cradle and having a lower end movable vertically and rotationally, a set of opposite links each pivotally coupled to an eccentric link and to opposite leaves of the cradle, a brake joining each clutch input shaft and eccentric link, whereby releasing the brake and powering the clutch input shaft will move an eccentric link for moving a leaf of the cradle.

* * * * *

UNITED STATES PATENT AND TRADEMARK OFFICE

CERTIFICATE OF CORRECTION

PATENT NO. : 5,009,563

DATED : April 23, 1991

INVENTOR(S) : Marvin L. Case et al.

It is certified that error appears in the above-identified patent and that said Letters Patent is hereby corrected as shown below:

On the title page please change the Assignee's address from "Hogiam, Wash." to -- Hoquiam, Wash. --.

In column 4, claim 1, line 21, please delete "cut" and substitute therefor -- out --.

In column 6, claim 6, line 2, please delete "opposite" and substitute therefor -- opposed --.

Signed and Sealed this

Eighth Day of September, 1992

*Attest:*

DOUGLAS B. COMER

*Attesting Officer*

*Acting Commissioner of Patents and Trademarks*